US009021619B2

(12) United States Patent
Paoluccio et al.

(10) Patent No.: US 9,021,619 B2
(45) Date of Patent: May 5, 2015

(54) MANHOLE ODOR ELIMINATOR

(76) Inventors: John J. Paoluccio, Modesto, CA (US); John A. Paoluccio, Modesto, CA (US)

( * ) Notice: Subject to any disclaimer, the term of this patent is extended or adjusted under 35 U.S.C. 154(b) by 632 days.

(21) Appl. No.: 13/415,344

(22) Filed: Mar. 8, 2012

(65) Prior Publication Data

US 2012/0227168 A1 Sep. 13, 2012

Related U.S. Application Data

(60) Provisional application No. 61/450,220, filed on Mar. 8, 2011.

(51) Int. Cl.

| | |
|---|---|
| ***E03D 9/02*** | (2006.01) |
| ***E03F 5/08*** | (2006.01) |
| ***E03C 1/122*** | (2006.01) |
| ***E03C 1/126*** | (2006.01) |

(52) U.S. Cl.
CPC ..... *E03F 5/08* (2013.01); *E03C 1/1225* (2013.01); *E03C 1/126* (2013.01)

(58) Field of Classification Search
CPC ..... A61B 10/007
USPC ..... 4/222–233
See application file for complete search history.

(56) References Cited

U.S. PATENT DOCUMENTS

| | | | | |
|---|---|---|---|---|
| 2,946,065 | A * | 7/1960 | Smith | 4/459 |
| 5,709,505 | A * | 1/1998 | Williams et al. | 405/128.2 |
| 2009/0200216 | A1 * | 8/2009 | Robinson et al. | 210/85 |

* cited by examiner

*Primary Examiner* — Lori Baker
(74) *Attorney, Agent, or Firm* — Robert S. Smith

(57) ABSTRACT

A sewer gas odor absorption apparatus for a manhole having a perforate manhole cover disposed in the manhole which includes an imperforate housing having a seal dimensioned and configured for sealing engagement with the manhole, the housing has a first extremity and a second extremity and a passageway in fluid communication with ambient air above the manhole cover at the first extremity and in fluid communication with sewer gases at the second extremity thereof. A sub-assembly including a porous absorption media and a variable volume device disposed in mutual fluid communication in a subassembly having first and second axial extremities, the first and second extremities of the subassembly being disposed in fluid communication respectively with the first and second extremities of the imperforate housing.

18 Claims, 9 Drawing Sheets

Prior art: Sewer gas flow through manhole

Sewer gases $H_2S$, $CH_4$, and air displacement

MANHOLE ODOR ELIMINATOR

CROSS-REFERENCE TO RELATED APPLICATIONS

This application is a continuation of provisional U.S. application 61/450,220, confirmation no. 7624 filed on Mar. 8, 2011.

FIELD OF THE INVENTION

The invention has particular application to methods and apparatus for a practical odor treatment apparatus to help reduce odors, associated with sewer gases, from escaping from sewer manholes that are part of a non-pressure sewer system. The escape of the odors into the ambient air constitutes a nuisance and/or presents a health risk to pedestrians and maintenance personnel. It will be understood that the term "non-pressure sewer system" includes gravity sewer systems. So-called pressure sewer systems are not vented to the atmosphere and do not have this issue. However, because pressure storage systems are more expensive, they are much less prevalent.

One of the harmful gases that is prevalent in sewage systems is hydrogen sulfide. Hydrogen sulfide is a colorless, flammable, extremely hazardous gas with a "rotten egg" smell. Some common names for the gas include sewer gas, stink damp, swamp gas and manure gas. It occurs naturally in crude petroleum, natural gas, and hot springs. In addition, hydrogen sulfide is produced by bacterial breakdown of organic materials and human and animal wastes (e.g., sewage).

Municipal sewer systems inherently carry varying capacities and concentrations of sewage, air and odorous gases. Although the present application will refer repeatedly to sewer manholes, those skilled in the art will recognize that the present invention has application to other manholes or closed areas as well as storm drain grates and vaults. For example, decaying vegetation within an underground drainage vaults may also produce gases that are malodorous and/or harmful.

Many known devices utilize a manhole insert below the manhole cover and an odor absorbing media such as activated carbon or other type media(s). The manhole insert may be plastic high density polyethylene (HDPE) or stainless steel with provisions for the gasses above the liquid in the sewer line or manhole to pass through, around or over the absorbing media, which is often activated carbon. Such systems treat the odor before it passes through the manhole cover to the street level. Such prior art devices may include a one way drain valve to allow water leaking through the cover to pass through the device. The device may also have a relief valve to prevent gasses from passing through the device until the sewer gas pressure in the manhole is above ambient air pressure. Lift handles may also aid in removing of the absorbing media. The absorbing media may also be in a cartridge or canister. The housing may be dish shaped with a support lip that fits between the manhole cover and the frame. This housing then becomes a barrier or seal between the sewer gases below and the treated air above the housing. Prior art housings are rigid and form a fixed volume barrier between the sewer gases and the treated air. In some cases chlorine or other chemicals is sometimes added to sewer systems to neutralize the sewer odors.

The primary problem with prior art devices is that fluctuations in the pressure or other conditions of the ambient air, treated air and sewer gas results in frequent flow in and out through the odor absorbing media. Such increased flow quickly depletes the capacity of the absorbing media and neutralizes the effectiveness and odor absorbing function of the absorbing media. This phenomenon will be better understood by the following elaboration. Each time a small volume of sewer gas passes through the odor absorbing media and becomes treated air that passes through the manhole cover it depletes part of the absorbing media. Likewise, each time a small volume of ambient air flows through the manhole cover and then passes through the odor absorbing media into the sewer gas area the absorber media is depleted. In addition, the original ambient gas is now contaminated with sewer gases and must again flow over or through the media to be decontaminated. (Thus, a once small volume of ambient air, immediately mixes with a very large volume of highly concentrated sewer gas and becomes contaminated.) Thus, the absorbing media will be still further depleted by the subsequent flow the same gas back to the ambient above the manhole cover. With frequent fluctuating air and sewer gasses passing back and forth through the absorber media the life of the media is quickly shortened thus requiring frequent replacement.

Furthermore, during the inward flow of air through the manhole cover an equal volume of the treated air (air between the carbon filter and the manhole cover) passes through the absorber material into the sewer gas containing area of the manhole. This movement of air also further degrades the absorber media.

Another problem with prior art is the preformed lip on the housing insert that fits between the manhole cover and frame for non-standard size manholes frequently does not fit properly. Most manhole covers were not designed to allow space for the support lip and molding apparatus for each unique size is very costly.

Problems inherent in prior art treatment methods that require frequent replacement of odor absorbing media include:

1. The high cost of labor to replace the odor absorbing media.
2. The high disposal cost and waste associated with the frequent replacement of odor absorbing media.
3. The high cost of frequent replacement of odor absorbing media.
4. The frequent disruption of personnel and vehicle traffic when service to manhole odor absorbing media is provided.
5. The added exposure danger to service personnel and those that are in the vicinity, of noxious sewer gasses due to the frequent replacement of odor absorbing media.
6. The frequent abandonment of manhole odor protection devices because they do not work well for long and become a manpower and financial burden to municipalities that are in charge of service.
7. Adverse dangers to health by all that breathe in or are exposed to the poorly treated sewer gasses escaping from the manhole cover.
8. Frequent service and removal of heavy manhole covers increases the risk for back injuries and other health problems as well as increasing workers compensation claims.
9. The initial cost for housing inserts having customized dimensions is very high.
10. Pre-molded housing inserts frequently cannot fit under manhole covers due to close tolerances between the cover and frame.
11. The use of chlorine and other chemicals to treat odors in sewer systems can cause unintended pollution problems to bays and other areas where the treated water eventually ends up.

BACKGROUND OF THE INVENTION

Various apparatus and methods have been devised to reduce sewer odors that are released from manholes. These include sealed covers, inserts with activated carbon and odor control materials, chlorine and chemical treatment and mechanical ventilation systems. Most of these methods do not deal with the fluctuations of sewer gas and ambient air movement in and out through the manhole cover. Frequently it is not practical or economic to provide some of these prior art methods such as chemical treatment or forced ventilation. Many sewer systems have just a few isolated manholes that have odor problems where an odor absorbing type insert can quickly be used to reduce odor complaints from pedestrians and businesses.

Sewer manholes customarily are disposed within a structure that has a relatively large volume of sewer gas above the sewer slurry and liquid in fluid communication with the flow portion of the system piping and the associated manhole covers. A slight change in sewer flow rate, chemical activity, temperature, ambient air pressure or wind velocity can cause an emission of gases from manhole covers or an inflow of ambient air into the sewer system. The gas pressure and the volume of gases within the system is not constant. Numerous environmental, biological, chemical, sewer flow rates and other conditions cause the gases within the system to be formed or displaced, expanded or contracted along with outside influences such as wind velocity over the grate, outside temperature and influences such as the fluid communication with other manholes, pumps, and flow streams. The lower the fluid in the sewer pipe the greater the volume above the slurry in the pipe. This is where many odorous gases are formed. Some municipalities have complained that the low flow plumbing shower and toilet fixtures have added to the odor problems by reducing flow rates that result in less scouring of the pipe interiors.

No two manholes are exactly the same as to emissions of sewer gases. From normal well known odor complaints by the public and experience, what is well known is that in certain manhole areas, they have very objectionable odors that occur at random times and at varying intensity. The sewer gas emissions and air egression into a manhole vary in volume size from very small to large quantities. The frequency of these fluctuations, also vary widely but certain times and conditions are more predictable problem periods. For example during time periods where more people are using plumbing fixtures at the same time over low use night time periods.

SUMMARY OF THE INVENTION

An object of this invention is to prevent, reduce or minimize sewer manhole odors from exiting manhole covers. The odor that escapes from sewer manholes through the cover is a common nuisance and gasses can be dangerous to health plus they have explosion potential. Venting may occur through pick holes, vent holes, and or the rim frame.

Another object of some embodiments of the present invention is to provide a practical variation with a simple universal housing support band that can easily fit any size manhole and not require customization for each of the respective sizes and shapes known to man.

Additional objects of the invention include providing an easy to install, long life device that needs a minimum of odor absorbing media replacement resulting in low overall costs and safer operation. With less service required, less disruption of pedestrian and traffic occurs along with less exposure to the harmful gasses by service personnel and others.

It has now been found that these and other objects of the present invention may be attained in a sewer gas odor absorption apparatus for a manhole having a perforate manhole cover disposed in the manhole which includes an imperforate housing having a seal dimensioned and configured for sealing engagement with the manhole, the housing having a first extremity and a second extremity; the housing having a passageway in fluid communication with ambient air above the manhole cover at the first extremity and in fluid communication with sewer gases at the second extremity thereof.

The apparatus also includes a sub-assembly including a porous absorption media and a variable volume device disposed in mutual fluid communication in a subassembly having first and second axial extremities, the first extremity of the subassembly being disposed in fluid communication with one of the first and second extremities of the imperforate housing and the second extremity of the subassembly being disposed in fluid communication with the other of the first and second extremities of the imperforate housing. The variable volume device having interior and exterior surfaces and an internal volume that is a function of the internal and external pressures on the respective internal and external surfaces of the variable volume device; and the variable volume device has a first internal volume when the pressure inside of the variable volume device is equal to the pressure on the external surface of the variable volume device.

In some embodiments of the apparatus the first extremity of the sub-assembly is in fluid communication with the first extremity of the housing and the second extremity of the sub-assembly is in fluid communication with the second extremity of the housing. The apparatus may have the internal volume of the variable volume device exposed to sewer gas and the external surface is exposed to air within the housing that is not within the bladder.

The apparatus may further include a pressure relief valve having an inlet in fluid communication with the housing and an outlet in fluid communication with treated air whereby surges in the sewer gas pressure relieve sewer gas to the interior of the housing and displace an equal volume of treated air that exits the manhole. The housing may be supported by a pan shaped support have a lip engaging the support surface for the manhole cover. The housing may be supported by a band extending around the housing and secured to a side wall of the manhole.

In other embodiments the housing may be supported by a band having first and second axial extremities that are respectively fixed to opposed faces of the manhole with the midsection thereof being curvilinear and at a lower elevation than the attachment points for the axial extremities. The housing may include a perforated riser pipe extending between the first and second extremities of the sub-assembly.

In some embodiments the variable displacement device is concentric with the riser pipe. Similarly, the absorbent media may be disposed in a cartridge. The cartridge may be substantially concentric with the riser pipe. In some embodiments the riser pipe is disposed in a substantially vertical orientation in normal operation and the highest extremity is exposed to ambient air and the lowest extremity is exposed to sewer gas.

Some embodiments of the present invention include a sensing tube communicating with the housing to allow determination of particular gases that may be present. Various embodiments of the present invention may include an indicator that displays the condition okay of the adsorbent media. For some applications the variable volume device has an internal volume without the application of internal or external pressures or other forces that is about half of the maximum internal volume of the variable volume device.

Another aspect of the present invention is the method for removing malodorous and harmful substances from sewer gases passing through and around a perforate manhole cover disposed in a manhole above an existing sewer conduit which includes providing an imperforate housing having an inlet and an outlet, the inlet and the outlet being in fluid communication; providing a seal between the housing and the manhole; providing an absorbent media within the housing; providing fluid communication between the housing and sewer gases in the sewer conduit; providing fluid communication between the outlet of the housing and ambient air above the perforate manhole cover; providing within the housing a variable volume device having a first internal volume when the pressure inside of the variable volume device is equal to the pressure on the external surface of the variable volume device; providing fluid communication between sewer gases below the housing and the internal volume within the variable volume device; providing fluid communication between ambient air above the manhole cover and the outer surface of the variable volume device; providing fluid communication between the internal volume of the variable volume device and the absorber media within the housing whereby the flow through the media is minimized by utilizing the variable volume device as a cache that reduces the impact of oscillations in sewer gas pressure and ambient air pressure.

Still another form of the present invention includes the apparatus for removing odors from an associated building vent such as the vent used for bathroom plumbing which includes a perforated riser pipe dimensioned and configured to engage and axially extend from the associated building vent that substantially seals with respect to the associated building vent to force all gases flowing through the vent to pass through the perforated riser pipe; a housing engaging the top of the vent and surrounding the riser pipe; a variable volume device surrounding the riser pipe within the housing; and an absorbent media disposed within the housing that is in fluid communication with the riser pipe whereby fluctuations in the pressure of gases rising through the vent and riser pipe and the pressure of the ambient air have a reduced impact on the total flow through the absorbent media because the variable volume device acts as a cache.

Yet another embodiment of the present invention is a sewer gas odor absorption apparatus for a manhole having a perforate manhole cover disposed in the manhole which includes an imperforate flexible housing having a seal dimensioned and configured for sealing engagement with the manhole, the housing having a first extremity and a second extremity; the housing having a passageway in fluid communication with ambient air above the manhole cover at the first extremity and in fluid communication with sewer gases at the second extremity thereof and a porous absorption media. The imperforate flexible housing has internal and external surfaces and an internal volume that is a function of the internal and external pressures on the respective internal and external surfaces of the imperforate flexible housing.

BRIEF DESCRIPTION OF THE DRAWING

The invention will be better understood by reference to the accompanying figures of the drawing in which.

DESCRIPTION OF THE PREFERRED EMBODIMENTS

Figure 1:
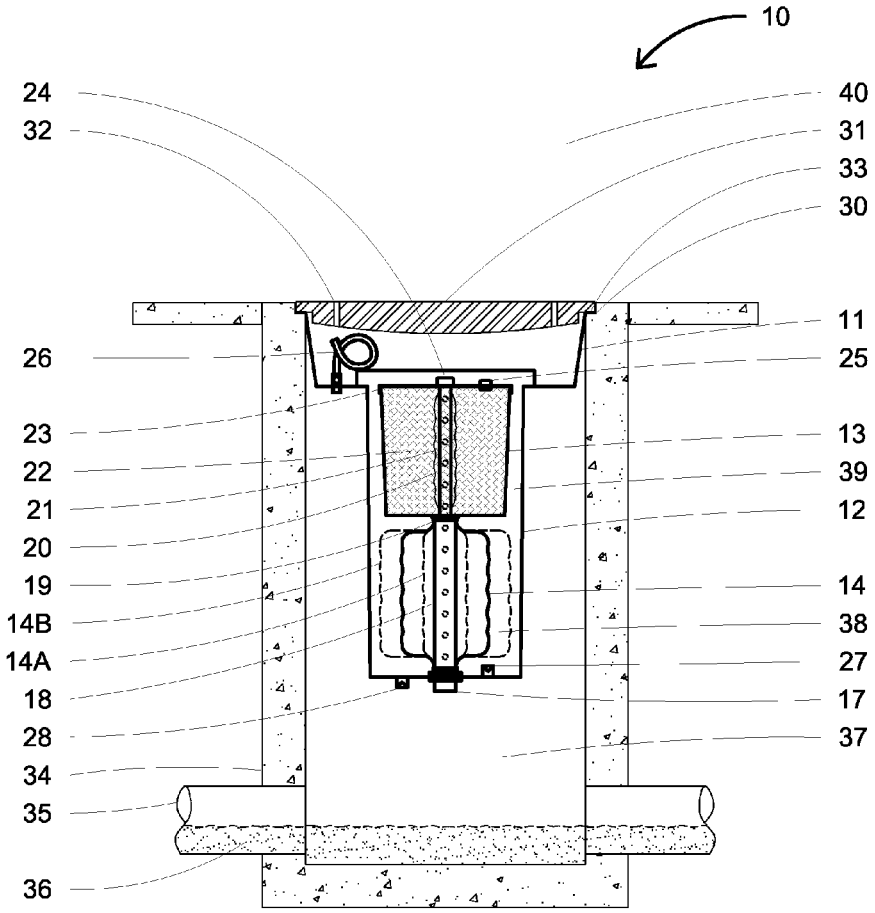
FIG. 1 is a schematic elevation view of a first embodiment of a manhole odor eliminator that shows the cross-section of a manhole insert, housing, odor absorbing cartridge and bladder.

In essence, the emissions and ingressions of air and gas in embodiments of the present invention are analogous to a lung during repetitive inhalation and exhalation cycles and wherein the cycles have a non-uniform amplitude and non-uniform frequency. This concept is the key to this invention. Some embodiments of the present invention use a variable volume device such as a biased pneumatic bladder. The term bladder as used herein refers to any pouch or other flexible enclosure that can hold liquids or gases. In some embodiments of the present invention the variable volume device is a bellows. Some vendors may refer to the variable volume devices as utilizing flexible containment technology. The volume of the variable volume device such as a bladder or bellows, may be constrained or biased by a spring, an elastic band, a raised weight, or a compressed gas. Although the variable volume device may be constrained or biased in this manner, many embodiments of the present invention rely on the physical and construction of the device to establish the normal position of the variable volume device. Thus, for example, a bladder having a 50% bias is constructed in a manner that results in the bladder, when sitting at rest on a planar surface without the application of any external forces, that will have a volume within the interior thereof that is 50% of the maximum volume which the device can be expanded to by the application of fluid pressure to the interior of the bladder.

Some embodiments of the present invention utilize a bladder biased to a volume that is 50% of the maximum volume of the bladder. Preferably the bladder is dimensioned and configured to contain the usual and customary quantity of the emissions of sewer gas and ingressions of ambient air within a volume that equals 50% of the maximum volume of the bladder. Only the peak overflow of the displacement volume that exceeds the portion captured in the bladder will be treated with the activated carbon. This extends the life of the odor absorbing media. In addition, by having a larger overall volume of treated air space above the sewer gas portion allows for a substantial volume of treated air that will be available to be expelled due to any burp or positive displacement or increase in volume of sewer gas that exceeds the bladder capacity. The large housing and insert volume can hold a large volume of treated air that is always ready to be expelled. Thus, when emissions occur, the treated air will be expelled first.

Manhole covers generally have a pick holes dimensioned and configured for engagement with a pick that are approximately 0.5 inch in diameter. The varying air pressure differential between the ambient air and the sewer gases usually fluctuate between plus or minus 0.01" water column. During this condition the gas flow rate will be plus or minus 0.5 cubic feet per minute. There are times where no flow occurs and times where much higher pressures occur. If, for example, the treated air volume between the sewer gases and manhole lid were 15 cubic feet, and a sudden high rate surge of sewer gas expelled 10 cubic feet above the capacity of the bladder, mostly odor reduced treated air will exit the manhole. The treated air portion of the apparatus is always being deodorized by the carbon cartridge.

Referring particularly now to FIG. 1 the manhole odor eliminator in accordance some embodiments of the present invention includes a high-density polyethylene (HDPE) manhole insert 11 having a flange that fits under the manhole between the grate and frame rim. A sealing ring or gasket 42 may be provided. The insert includes a large opening dimensioned and configured to allow the body of a housing 12 to pass through the opening and to engage a circumferential lip on the housing 12 as shown in FIG. 1. In one embodiment of the invention, the high-density polyethylene (HDPE) housing 12 is a cylindrical tank having an open top surrounded by the circumferential lip. The housing ordinarily holds an odor absorbing media that is contained in a cartridge 13 or filter in the upper portion of the housing 12.

The cartridge 13 is filled with odor absorbing carbon and/or other absorbents in other embodiments of the invention. The cartridge 13 has a perforated outer shell or in some cases a screened cartridge housing to constrain the carbon media within the cartridge while concurrently allowing gas to flow through or pass over the media within the cartridge. The cartridge 13 further includes a center perforated tube or perforated riser pipe 20 through which sewer gases pass through cartridge 13. A securing cap or cover 24 holds the cartridge in place on the perforated riser pipe 20. In a typical embodiment the bottom of the perforated tube 20 contains a ½" diameter orifice that slightly restricts sewer gas flow, and connects to a 1½" riser pipe. The riser pipe 20 extends downward and fits through the bottom of the housing 12 with an opening or riser pipe inlet 17 for sewer gases. A bladder 14 fits over the riser pipe 20. The riser pipe 20 has perforations to allow sewer gases to enter the bottom of the riser pipe, pass through the perforations and enter the bladder interior.

A variable volume device, which may be in the form of a bladder 14 is connected to the perforated riser pipe 20 so the interior volume of the bladder 14 is in fluid communication with the sewer gasses below. When any fluctuation in sewer gas volume occurs, the expansion or contraction of the gas volume affects the bladder. More specifically, the bladder expands or contracts in response to the expansion or contraction of the gas volume of the sewer gases. If, for example, any displaced sewer gas volume that occurred due to thermal temperature conditions or changes in the sewer flow rate or velocity or the changing level of the sewer liquids, or any chemical or biological or other reason, the displaced sewer gasses volume will enter or leave the bladder. The variation in volume may only be a fraction of a cubic foot or more. However, repetitive occurrences of these volumetric changes in the prior art apparatus dramatically increases the depletion of the absorbent media. The apparatus of the present invention utilizes a variable volume device, such as a bladder, that substantially reduces the impact on the media because the variable volume device dramatically reduces because of repetitive volumetric changes. In normal operation the volumetric changes will impact only the size of the variable volume device without causing flow of contaminated gases repetitively over the media. Thus, in a typical environment the quantity of contaminated gases passing over the media in the apparatus of the present invention may be 20% or less of the quantity of containment gases passing over the media in the prior art apparatus. This feature may extend the practical life of the absorber media to one to two years whereas prior art systems require a change in a 4 to 6 months or less.

The manhole odor eliminator in some embodiments includes a water drain trap (also called a P-trap) 15 creates a 2" water seal that allows any rainwater that passes through the manhole lid to enter the housing and then pass through a 1" drain tube 16 that extends near the bottom of the drain trap 15, thereby creating a water seal, with excess water overflowing the rim of the drain trap 15 and entering the sewer system below. During periods of high sewer gas pressure surges, a portion of the sewer gas can pass through the drain trap into the housing 12. This untreated gas will displace and mix with the treated air with part of it exiting the manhole.

The odor treatment apparatus provides a housing 12 that forms a treatment chamber between the manhole cover and the sewer gases. An odor absorbing filter media cartridge 13 "filters" the sewer gas flow into the housing 12. A lightweight bladder 14 acts as a buffer for the sewer gases flowing through the cartridge by accommodating the frequent gas and air flow in and out through the cartridge 13. Only flow rates that exceed the bladder capacity flow through the cartridge 13. This greatly extends the life of the cartridge. The treated gas disposed in the space between the housing 12 and the manhole cover 31 becomes treated air. That treated air is expelled when a pulse of sewer gas rushes through the cartridge 13 that exceeds the bladder 14 maximum expansion volume.

A variable volume device in the form of a flexible housing or bladder 14 that is normally in a partially biased position (partially collapsed) remains in fluid communication with sewer gases. This bladder will accommodate the frequent fluctuations of displaced sewer gas and displaced treated air thereby reducing the flow of sewer gas that passes through the odor absorbing filter media. This greatly extends the active life of the odor absorbent. The present invention describes an apparatus which, when inserted into a standard manhole of any of size, reduces the odors which are typically vented to the atmosphere from the manhole. By greatly reducing the fluctuating flow of sewer gas and treated air through the cartridge the life of the odor absorbing media is greatly extended. This allows for significantly less service and replacement of the odor absorbing media.

The sewer manhole odor eliminator (MOE) apparatus in accordance with the present invention fits under manhole covers of various sizes. The apparatus contains a housing with a perforated riser tube, variable volume bladder, and an activated carbon cartridge for removal and odor control of Hydrogen Sulfide and other odors typically found in sewer gases. Fluctuating sewer gas volumes that exceed the bladder volume will be treated through the cartridge. This causes an equal volume of treated air to exit the manhole cover. This apparatus reduces or eliminates vented nuisance odors above the manhole cover. During long periods of no flow or air pressure changes, the air space between bladder and manhole cover will continue to be treated by exposure to the activated carbon cartridge to further reduce any remaining sewer gases in the treated air.

The manhole odor eliminator (MOE) is comprised of a manhole insert 11, HDPE housing 12, odor absorber cartridge 13, pressure relief valve or orifice 19, perforated riser pipe 18, bladder 14, water drain tube 16 and water drain trap 15 or P-trap or drain valve. A manhole insert 11 in one embodiment of the present invention is a fabricated stainless steel or plastic shaped insert dimensioned and configured to fit a specific size manhole frame 33. Thus, a typical embodiment has a cylindrical pan shape. The insert 11 may vary in size from 18" diameter to 48" diameter. Various embodiments are square or rectangular to accommodate the manhole size and shape. The plastic insert 11 in some embodiments has a thickness of 3/16" although other embodiments may be thicker or thinner. In some embodiments insert 11 may be 6" to 10" deep although other embodiments may have other dimensions. A hole is provided in the insert to accommodate a removable HDPE housing 12. Such a removable housing 12 has certain cost advantages because it allows for utilization of a more uniform or standard size housing with a more uniform size cartridge and a bladder so that the entire or assembly will fit with virtually all outside diameter manhole insert 11. Standardization of such components will result in economies of scale with regard to manufacture, distribution and stockpiling or warehousing spare units required for maintenance. Typical manholes 31 may be 24, 30, 36" in diameter as well as many other sizes. Variation note: In some cases the manhole insert 11 may have a built in deep housing. For example a 14" diameter by 24" deep lower portion built in housing may be provided. In this variation the insert and housing might be molded as one piece. This variation has certain cost advantages with large quantities on one specific manhole cover size. An alternative to the lip shaped suspension described and shown in FIG. 1-3.

Figure 6B:
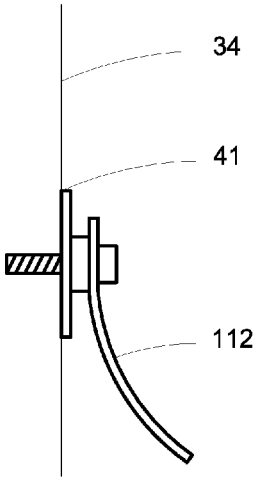
FIG. 6B is a partial view of the support band with welded nuts and holes for use in securing the band to the interior of the concrete wall of the manhole.
Figure 6C:
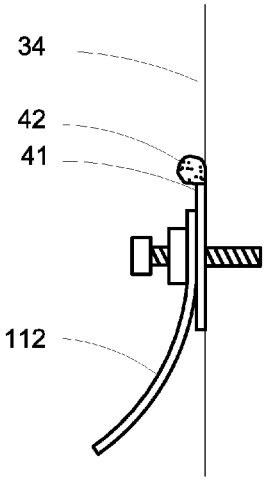
FIG. 6C is a partial view of the manhole odor eliminator with a support band, ring gasket and flexible housing that act to accomplish the same function of the manhole insert, housing and bladder.
Figure 6A:
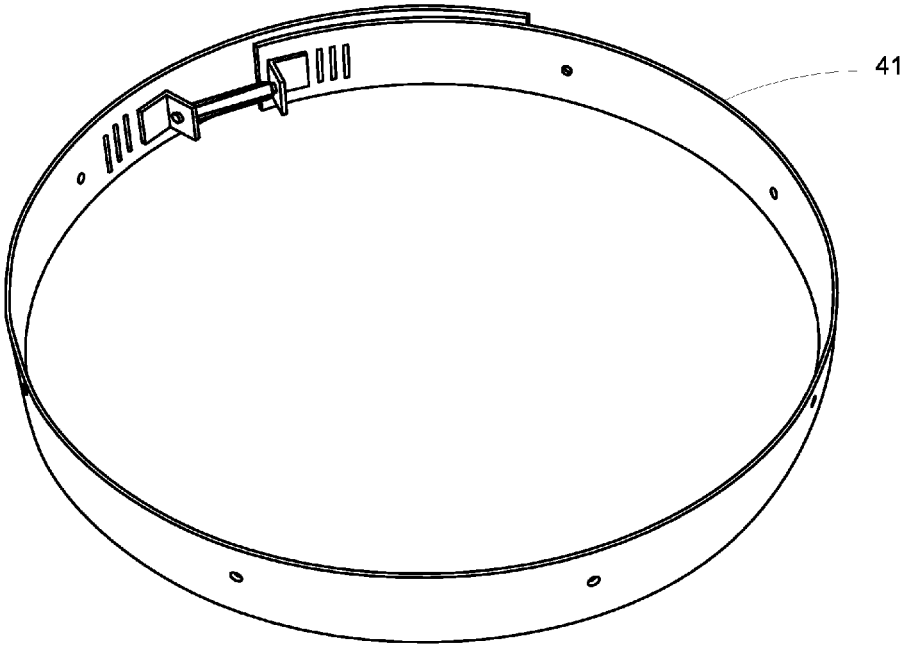
FIG. 6A is an enlarged view of the support band utilized in the embodiment of FIG. 5 that includes a welded nut and hole for use in securing brackets and a housing.

Alternate embodiments of the present apparatus replace the support lip with fabricated or pre-manufactured specific size inserts 11, and support the manhole housing insert may have a universal support band 41 as shown in FIGS. 6A, 6B, and 6C that can be expanded to fit any diameter manhole 34. In some embodiments the support band 41 is a 3" wide, 12 gauge circular stainless steel band with a series of holes and with welded nuts over holes for use in fastening brackets, securing the housing and anchoring the band 41 to the manhole 34 interior. An expansion device such as a long threaded bolt with nuts and brackets can be used to crank the band to expand tightly to the interior of the manhole. Once tightened, a drill can be used to pass through the welded nuts into the manhole basin. Angle support brackets may be used to help support band to lip of the manhole frame 33.

A standard removable HDPE housing 12 is utilized in some embodiments of the present invention. This approach maximizes the economies of scale. Such a uniform housing 12 will normally fit in any size manhole insert 11. The housing 12 may be a HDPE open top tank with a volume capacity of 15 gallons. The purpose of using larger volume housing is to maintain a large treated air 39 volume between the manhole cover 31 and the housing 12. This space includes the volume of the manhole insert and available housing space. The housing contains a riser pipe 18 and a bladder 14. This is in contrast to many prior art systems have a relatively small volume of space that can hold treated air. Some prior art devices simply have a manhole insert with a container of activated carbon. The treated air volume may only be 1 to 2 cubic feet. Embodiments of the apparatus in accordance with the present invention utilize a relatively large housing 12 to hold the cartridge 13 and bladder 14 for additional treated air 39 space. Certain sewer manholes have more active sewer gas odor problems due to greater volume displacements and larger housings 12 will hold more treated air.

The operation of the present apparatus will be better understood by considering a hypothetical operating condition characterized by a small fluctuation of sewer gas and ambient air pressure, volume and flow. When a "burp" or displacement of sewer gas occurs, from a positive gas pressure, the bladder will expand to accommodate all or a portion of the "burp" volume. This in turn will displace an equal volume of treated air that will exit the manhole cover into the ambient air. As long as the bladder capacity is not exceeded, either no sewer gas or a very slight amount of sewer gas will pass through the activated carbon cartridge 13.

Subsequently, when the ambient air 40 pressure was greater than the pressure of the sewer gas 37, ambient air 40 will enter through the manhole 31 cover. An equal volume of treated air 39 will first displace the bladder 14 volume. As long as the bladder 14 capacity is not exceeded, either (1)

none of the treated air 39 or (2) a slight amount of treated air 39 will pass through the activated carbon cartridge 13 into the sewer gas 37 space.

The operation of the present apparatus will be better understood by considering a hypothetical operating condition characterized by a large fluctuation of sewer gas 37 and ambient air 40 pressure, volume and flow. Once the sewer gas 37 fluctuation resulted in a displacement that exceeds the bladder 14 capacity, only the excess sewer gas 37 will result in flow through activated carbon cartridge 13. When this occurs, treated air 39 will first exit the manhole 31 and then a mixture of treated air and sewer gas will exit the manhole 31 cover.

The odor absorbing media 13*a* in the cartridge 13 may be activated carbon with a hydrogen sulfide treatment additive or some other odor absorbing or neutralizing media. One preferred material is Coconut Shell Activated Carbon for $H_2S$ Adsorption by Carbon Activated Corporation. The properties include: $H_2S$ Capacity (ASTM D6646-03) of 0.30 g/ml, min. This material is 4.0 pelletized designed for vapor phase odor control. The cartridge 13 in some forms of the invention has a 12" diameter, a 10" height with a concentric 3" diameter perforated tube in the center of the cartridge. This allows it to slip over a 2" diameter perforated riser pipe 20 with a pressure relief valve 29 or ½" diameter orifice 19 restrictor between the cartridge 13 and bladder 14 and in fluid communication with the sewer gases 37.

The cartridge 13 acts to remove, reduce or eliminate the odor associated with the sewer gases 37 driven by a positive pressure through the cartridge media and while any sewer gases remain in the treated air 39 space. As the sewer gases pass through the cartridge it becomes treated air 39. Since this invention includes a variable volume device or bladder 14, the amount of sewer gases 37 that passes through the cartridge 13 is greatly reduced to an estimated 20% to 30% of prior art systems without a bladder. This allows for much less absorber media to be used and reduces the need for service and cartridge 13 replacement by several times.

The cartridge 13 in some embodiments of the present invention may be a single complete replaceable module that is replaced as required. In some embodiments of the present invention the odor absorbing carbon 13*a* media may be disposed in a removable filter sack. Thus, a used removable filter sack may be removed with a simple cap removal and replacement of the carbon 13*a* media in a fresh removable filter sack. The maintainer of the apparatus will not be burdened with the task of changing out 20 pounds of activated carbon 13*a* media every 2 to 4 months for a total of 60 to 120 pounds total per year as required with some prior art devices. In a hypothetical example embodiments of the present invention will use on one cartridge every year with a total activated carbon 13*a* media use of 10 to 20 pounds per year. Of course, the actual use may differ because the actual sewer gas volume fluctuation and concentration will vary widely at respective sites. Other odor absorbing media can be provided in addition to or in place of the activated carbon media to control the hydrogen sulfide and other sewer gases that can exit at manholes. An activated alumina media with chemicals to remove hydrogen sulfide and iron based chemicals that convert hydrogen sulfide to solids and pyrite like substance may also be used. Some of these change color after use.

The cartridge 13*a* may also, in some embodiments, have an indicator sight glass 25 with color changing media on top of the cartridge. This allows for visual inspection of media condition without removal of cartridge and alerts service person when the media should be replaced.

All pressure relief valves may be of flap, ball float, check or other type valves. In most applications, it is preferable that each valve is adjustable so that the valve can be set at one of a range of different relief pressures. A low pressure relief valve 27 is located at bottom of housing 12. This allows air or water flow at 0.25" water column or other setting. Rainwater that collects in housing 12 can drain through the valve. Also, when the sewer gas pressure is less than the ambient air pressure, air 38, 39 will pass through the valve into the sewer gas 37 area. A high pressure relief valve 28 is located in the housing 12 to allow for high pressure surges of sewer gases 37. If a surge exceeds the maximum flow rate through the cartridge 13, the high pressure relief valve 28 allows sewer gas to enter the housing 12. Typically, the high pressure relief valve 28 is set at 3" water column although various applications may require another setting. A medium pressure relief valve 29 is located in the riser pipe 18 between the bladder 14 and the cartridge 13. This helps direct positive pressure sewer gas 37 flow into the bladder 14 first and may be set at 0.2" to 1" positive water column or other setting. The excess sewer gas 37 will thus flow through the carbon cartridge 13. In lieu of the medium pressure relief valve 29 a small ½" diameter orifice 19 may be fitted in the riser pipe 18 between the cartridge 13 and the bladder 14. This orifice 19 restriction and the resistance of flow by the carbon 13*a* helps direct any positive pressure sewer gasses 37 first into the bladder 14 to accommodate gas fluctuations. In some cases no orifice or pressure release valve is required and the pressure drop through the activated carbon 13*a* in the cartridge 13 is all that is required. The pressure drop will depend on the resistance to flow by the odor absorbing media.

The housing 12 shall have a partially perforated tube or riser pipe 18 that may be a 2" PVC pipe from the center bottom of housing 12 extending upward to an orifice 19 or pressure release valve 29. The perforated riser pipe 20 extends through the center of the odor absorbing cartridge 13. The riser pipe 18 is open at the bottom and is in fluid communication with the sewer gases 37. The function of the riser pipe is to allow displaced sewer gases to first travel to a bladder instead of entering the cartridge. A low pressure relief valve (PRV) or orifice may be located in or at the riser pipe above the bladder and below the odor absorber cartridge. In the preferred embodiment the bladder 14 may encompass a portion of the riser pipe 18 as shown on the drawings.

The bladder 14 in some embodiments of the present invention is in fluid communication with the sewer gases 37 and thereby allows at least a portion of displaced sewer gases to first enter the bladder 14 instead of passing through the odor absorber cartridge 13. The bladder 14 is ordinarily biased in a midway or partially closed or deflated condition so it is always ready to receive sewer gases or be further depressed when the treated air pressure exceeds the sewer gas pressure. For example, a 2 cubic foot volume bladder biased to 50% will allow plus or minus 1 cubic foot of displacement. In a preferred form of the invention the bladder 14 may have an outside diameter of 12" diameter by 18" high and with a volume of over 1 cubic foot. The bladder will be in this maximum position only when the pressure of the sewer gas was above the treated air pressure above the cartridge. When no-pressure differential exists the bladder 14 will be biased to a 50% volume position of 0.50 cubic feet and be 9" diameter by 18" high. If the treated air pressure was above the sewer gas 37 pressure, the bladder 14 will deform, adjacent to and around the perforated riser tube 18, to the minimum near zero volume.

Increase or decrease in bladder 14 volume will occur when there is a very low pressure differential in the order of fractions of an inch of water column. The fluctuating volume range will be from zero to 1 cubic feet. Larger or smaller bladders are used to suit application. The bladder may be constructed of a thin pliable butyl rubber, polyethylene, urethane or neoprene coated nylon fabric or any other flexible material with a bias to a predetermined normal no-pressure condition of approximately 50% volume capacity. Thus, the bias of the bladder is inherent in the construction of the bladder. The material is preferably resistant to the hydrogen sulfide and other common sewer gases found in sewer systems. In some embodiments the bladder has a 2" diameter opening connection in fluid communication with the sewer gases as well as in fluid communication with the odor absorbing cartridge.

The volume of sewer gases may be affected by any one or more of multiple possible occurrences. For example, any ambient air or treated air condition may cause a fluctuation in volume. Ordinarily, the variable volume device such as the bladder 14 minimizes repetitive flow of sewer gas through the cartridge 13. In some cases a change in pressure above the manhole cover 31 may cause the bladder 14 to contract and have the least possible internal volume. Such an occurrence will cause treated air to pass through the cartridge and back into the sewer gases area of the manhole where it will immediately be contaminated. Without the bladder 14, the fluctuations of sewer gases and treated air volumes passing through the odor absorber cartridge will significantly deplete the odor absorbing properties of the media in the cartridge. In another form of the invention the bladder may be biased to other volumetric positions such as 25% or 75% of the maximum volume of the bladder 14. The volumetric changes in such embodiments have utility when ambient air is drawn through the manhole. For example if any condition caused 1 cubic foot of ambient air to be drawn through the manhole cover this same volume will depress the bladder from its 50% position to a lesser volume. Thus, the volumetric changes prevent treated air that has already been exposed to the activated carbon media from re-entering the sewer gas area. With the frequent fluctuations in volume that occur, this feature will extend the life of the odor absorbing media. Likewise, if 0.5 cubic foot of sewer gas were to be displaced or added to the area below the manhole odor eliminator 10, the displaced 0.5 cubic foot volume will enter the bladder 14 to expand the internal volume of the bladder 14 by 0.5 cubic foot. This feature prevents the fluctuating sewer gas displacement from passing through the absorber cartridge.

In various embodiments of the present invention the variable volume device may also be a bellows, accumulator or a deforming sheet of flexible material or the housing 12, 14 may be flexible. The housing may be flexible and in some variations it may extend to a large volume above the sewage 36 level. As noted elsewhere herein, the variable volume device may take many forms. One embodiment utilizes a lightweight bladder that will inflate at a very low pressure. A 1 mill polyethylene trash bag, for example, may be inflated by a human blowing in the opening. Other embodiments use a 3 to 6 mill polyethylene bag for the bladder.

Existing prior art systems may require replacement of 20 pounds of the absorber media every 3 months to help keep the odors under control. This may equal 80 pounds of activated carbon every year. However, many municipalities with limited resources are slow to service some of these installed applications and operate with spent absorber media due to the high cost of service and replacement. In other words the odor absorber media quickly becomes depleted and has no utility. This invention may only require 20 pounds of absorber media and it may need to be changed every 6 months or yearly. This will equal 40 pounds of activated carbon every year or one half that of prior art. In some applications with more frequent small volume fluctuations the media may last over a year wherein only 20 pounds a year will be required.

In lieu of a low pressure relief valve 27, a 1" diameter water drain tube 16 provided with an opening at the bottom of the housing and extend to near the bottom of the water drain trap 15. When rainwater enters the manhole 21 pick hole or frame it drops to the bottom of the housing and enterers the drain tube 16 and drains to the drain trap while maintaining a water seal. In addition, when a high pressure surge of sewer gas occurs that exceeds the capacity of the bladder 14, the excess portion of the sewer gas 37 will force its way through the drain tube 16. First it will force some of the water in the drain trap 15 up the drain tube and enter the housing 12. Then the excess sewer gas will enter the housing directly. When the high pressure subsides, the water in the housing will drain back to the drain trap.

Figure 2A:
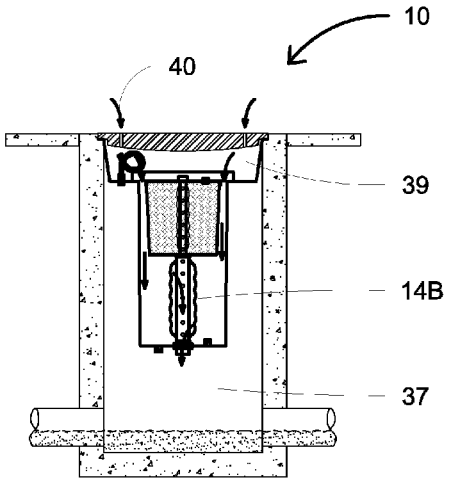
FIG. 2A is a diagrammatic view of a manhole odor eliminator with the bladder in a minimum volume position. In this case the ambient air pressure is higher than the sewer gas pressure.
Figure 2B:
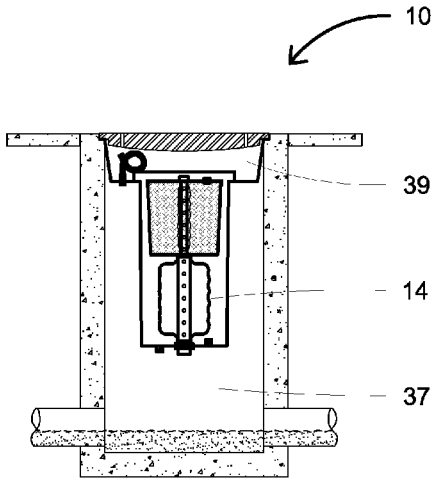
FIG. 2B is a diagrammatic view of a manhole odor eliminator invention with bladder in neutral or bias position. In this case the ambient air pressure and the sewer gas pressure are the same. Thus, the bladder is in the position defined during manufacture that exists when no external or internal forces are applied to the bladder.
Figure 2C:
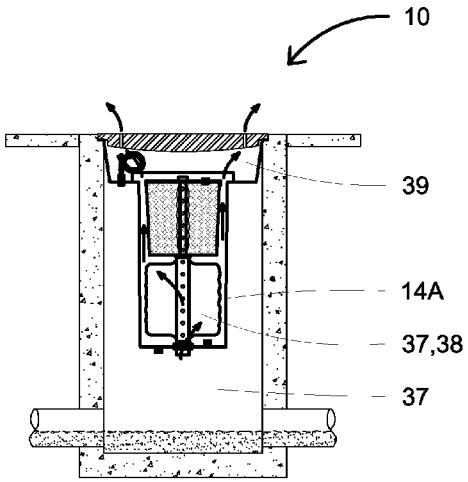
FIG. 2C is a diagrammatic view of a manhole odor eliminator with the bladder in maximum volume position. In this case the sewer gas pressure is higher than the ambient air pressure. If 1 cubic foot of sewer gas entered bladder, no flow occurs through cartridge and 1 cubic foot of treated air exits the manhole cover.
Figure 2D:
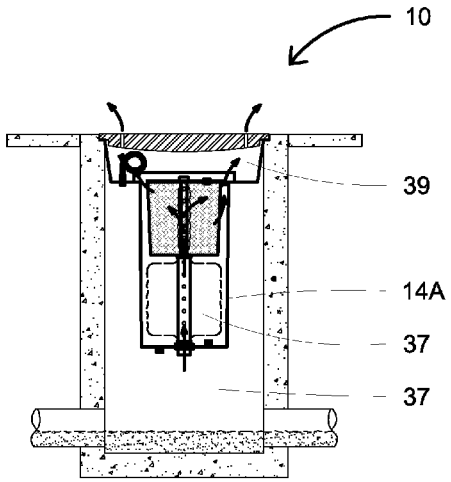
FIG. 2D is a diagrammatic view of a manhole odor eliminator with the bladder in maximum position. In this case the sewer gas pressure is higher than the ambient air pressure. If 2 cubic foot of sewer gas entered inlet pipe, one cubic foot of sewer gas will enter the bladder and 1 cubic foot of sewer gas will pass through the cartridge where it becomes treated air and 2 cubic feet of treated air exits the manhole cover.

FIGS. 2A-2D illustrate sequential operating steps of the system shown in FIG. 1. FIG. 2A illustrates a manhole odor eliminator with the bladder in a minimum volume position. In this case the ambient air pressure is higher than the sewer gas pressure. FIG. 2B is a diagrammatic view of a manhole odor eliminator invention with bladder in neutral or bias position. In this case the ambient air pressure and the sewer gas pressure are the same. FIG. 2C is a diagrammatic view of a manhole odor eliminator with the bladder in maximum volume position. In this case the sewer gas pressure is higher than the ambient air pressure. If 1 cubic foot of sewer gas enters the bladder 14, no flow occurs through cartridge 13 and 1 cubic foot of treated air exits the manhole cover. FIG. 2D is a diagrammatic view of a manhole odor eliminator with the bladder 14 in maximum volume position. In this case the sewer gas pressure is higher than the ambient air pressure. If 2 cubic foot of sewer gas entered inlet pipe, one cubic foot of sewer gas will enter the bladder and 1 cubic foot of sewer gas will pass through the cartridge where it becomes treated air and 2 cubic feet of treated air exits the manhole cover.

Figure 3:
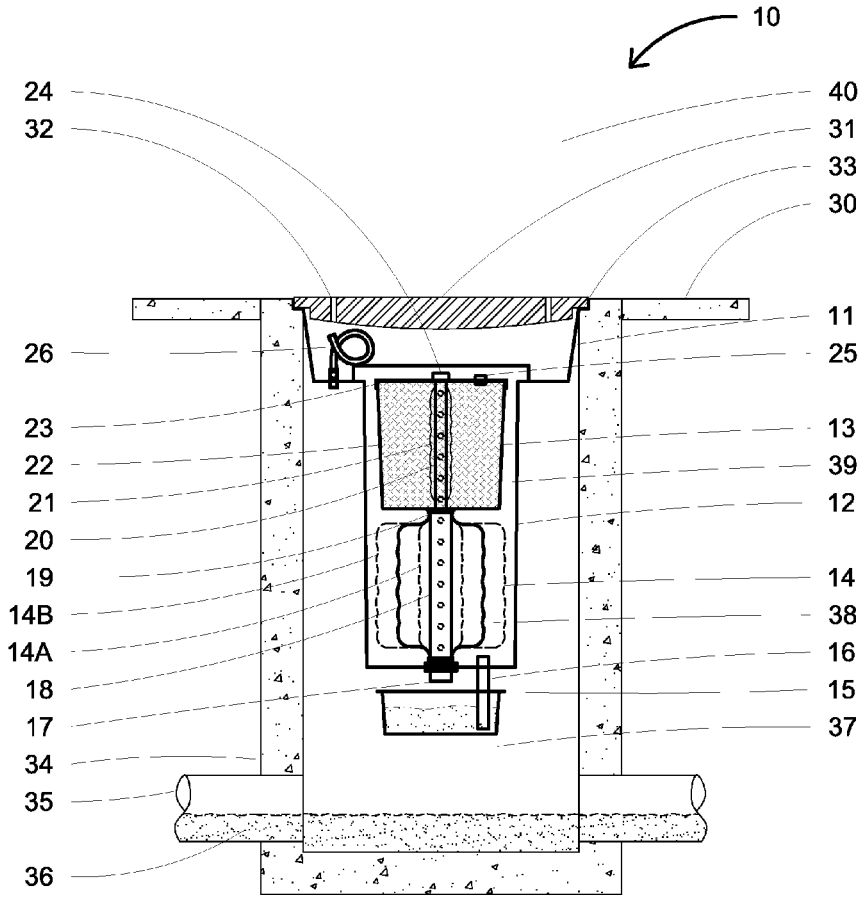
FIG. 3 is a schematic elevation view of a second embodiment of the manhole odor eliminator that shows the cross-section of a manhole insert, housing, odor absorbing cartridge and bladder. This view shows a water drain trap and drain tube in lieu of pressure relief valves.
Figure 4:
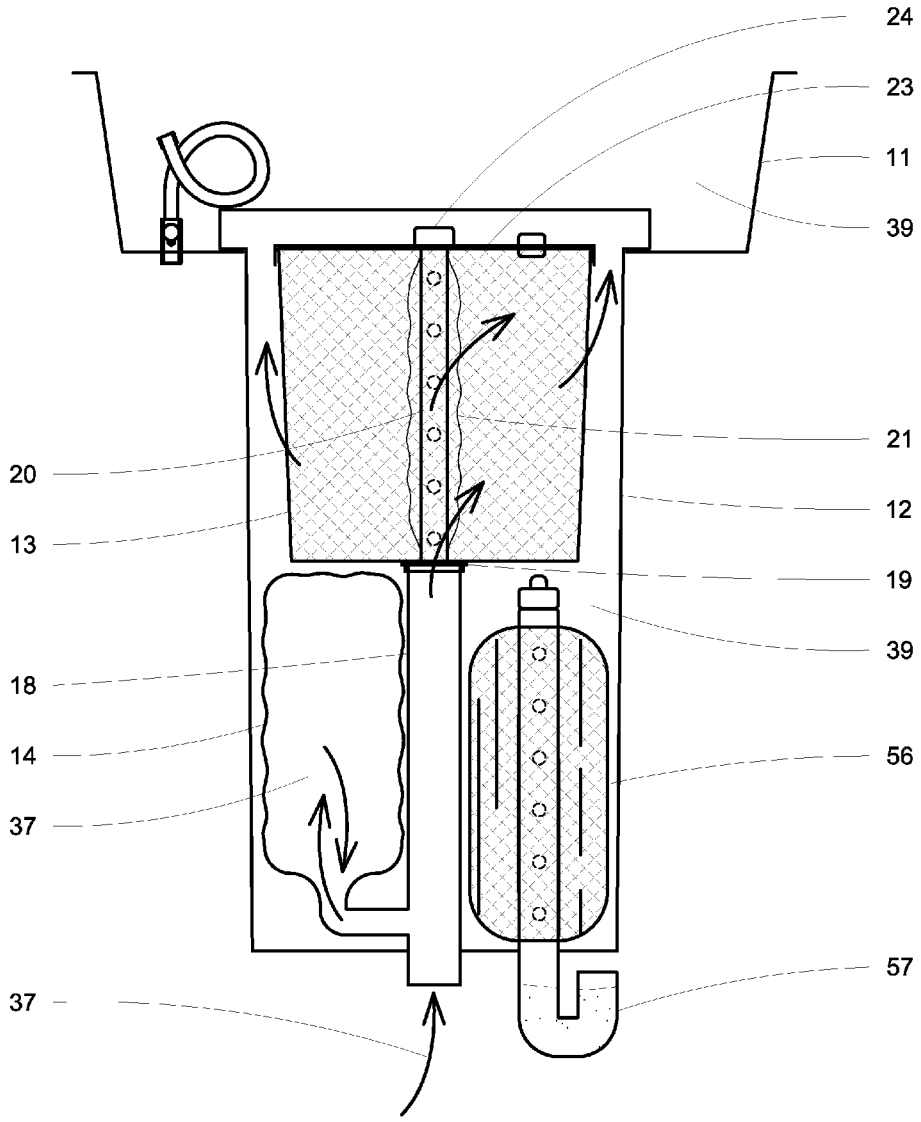
FIG. 4 is a schematic elevation view of a third embodiment of the manhole odor eliminator for applications where the drain water needs to be filtered. A water filter is shown that filters and absorbs hydrocarbons and chemicals from the water before draining while maintaining a water seal.

As best seen in FIG. 3, in lieu of a high pressure relief valve 28, a water drain trap also known as a P-trap 15 may be provided below the housing to allow drainage of any water that passes through manhole 31 cover, pick hole 32 or frame 33 while forming a water seal thereby preventing sewer gases from entering the treated area or housing. The rim of the water drain trap 15 is suspended at least 1" below the bottom of the housing, to maintains an air gap, and is in fluid communication with the 1" drain tube 16.

Referring now to FIGS. 6A-6C various other embodiments may include other alternate constructions. For example, some manhole frames and lids are difficult to fit with a pre-manufactured plastic dome flange insert 11. The following description includes a 12 gauge stainless steel metal band 41 that may be 2" to 3" wide and circumvent the interior of the manhole 34 opening below the frame 33. An expansion securing device tightens the band to the interior of the manhole opening. The band in some case is located 4" below the frame. Threaded nuts that are welded to the band allow for anchoring the band firmly to the concrete opening. A ⅜" drill may pass through the nut and band to provide a hole in the concrete for a threaded bolt to pass through the nut, metal band and enter the hole in the side of the manhole. The forces on the bolt are in shear and can withstand high forces and protect against slippage downward even if the band becomes loose. Brackets can be secured to the band that can extend to support the housing and odor absorber cartridge 13.

Figure 5:
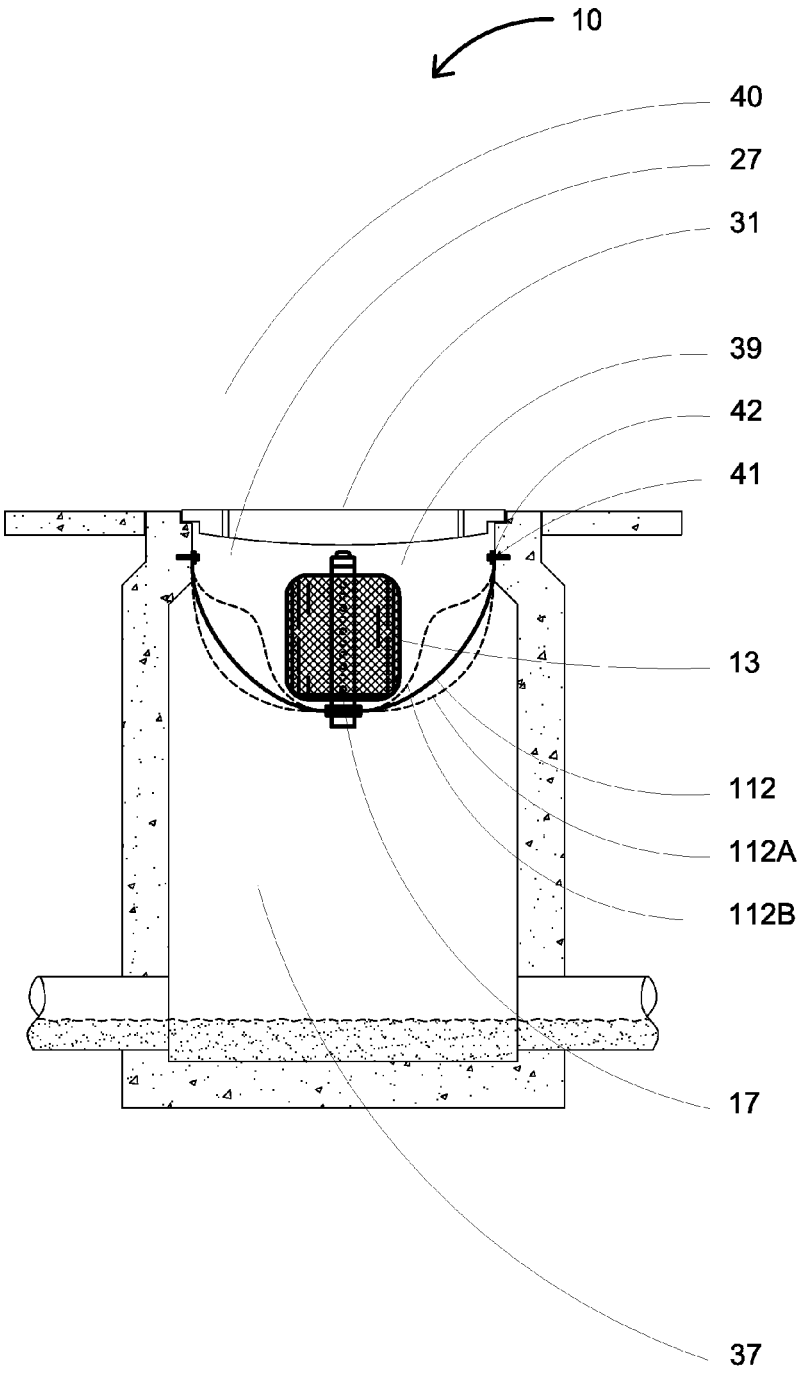
FIG. 5 is a schematic elevation view of fourth embodiment of the manhole odor eliminator that includes an alternate support apparatus having a support band that circumvents the manhole interior. The band is tightened by an expansion device. The manhole insert, brackets, flexible housing (bladder) and cartridge are all supported by the band.

Referring now to FIG. 5 and FIG. 6C a fourth embodiment of the manhole odor eliminator is illustrated. This embodiment also uses a variable volume device. Unlike other embodiments that use a bladder, this embodiment utilizes a flexible housing 112 that is functionally equivalent to the bladder 14 in other embodiments. The flexible housing 112 is secured to the support band with a ring gasket 42 to form a tight seal to the manhole interior. The ring gasket 42 is a foam material or an inflatable flexible tube filled in various embodiments. The flexible housing 112 can contour to the absorber cartridge 13 much more closely than the rigid housing 12. When sewer gas pressure is positive the flexible housing 112 deforms to minimum volume before gases start to flow through cartridge 13. When sewer gas pressure is negative the flexible housing 112 deforms to maximum volume before treated air passes through cartridge 13 into the sewer gas area. This embodiment includes an alternate support apparatus having a support band 41 that circumvents the manhole interior. The band 41 is tightened by an expansion device. The manhole insert, brackets, flexible housing (bladder) and cartridge are all supported by the band 41 The flexible housing 112 is shown in alternate positions. The drawing illustrates diagrammatically the expanded or inflated position 114B of the flexible housing 114 and the deflated position 114W of the flexible housing 114.

Figure 7:
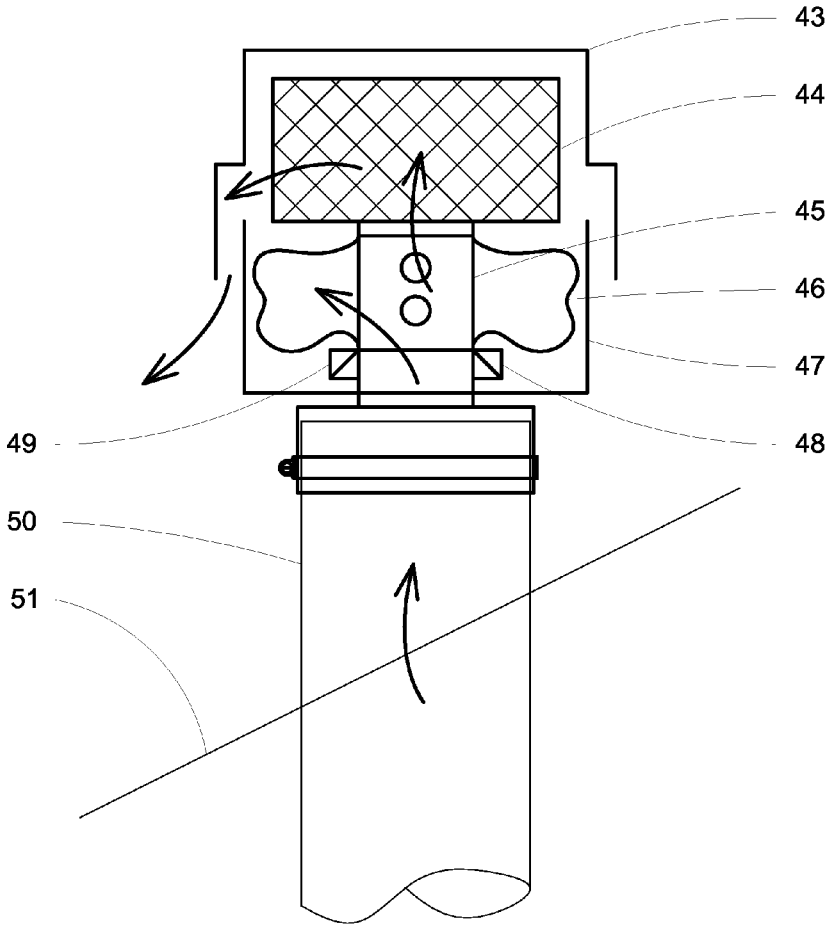
FIG. 7 is a schematic view of a manhole odor eliminator mounted on the top of a residential plumbing vent to reduce odors from such vents.

As best seen in FIG. 7 a small variation of the manhole odor eliminator 10 may be applied to office and residential plumbing vent pipes 42 that extend through the roof and emit nuisance odors. In this variation the main basic components are rearranged as shown in FIG. 7. This illustration shows a perforated pipe riser pipe 45 surrounded by a bladder 46. The assembly includes a removable service cap 43, small carbon cartridge 44, small perforated riser pipe 45, small bladder 46, cartridge housing 47, pressure relief valve 48, vacuum relief valve 49, plumbing vent 50 and roof surface 51

Commonly, manhole 31 covers are 22" to 48" in diameter although other sizes are known. They are generally of round shape to prevent falling through the round opening. The average weight may be 250 to 300 pounds. They may contain several "pick" holes having a ⅝" diameter that may be referred to a "vent" holes. Some covers may be without holes to form a tighter seal. Sewer gas leaks through the "pick" or "vent" holes and or the rim that may not be a gas tight fit due to dirt, debris, rust or deformed cover or frame. The sewer gases 37 that escape through a manhole cover may be caused by numerous conditions including environmental, thermal temperatures, wind velocity, air pressure changes, sewer flow rates, biological activity, chemical activity, sewer pipe fluid level, manhole position in system, forced pumping systems, and many other factors. If the total vent area through the pick 32 holes equaled ½ square inch orifice, and if the pressure differential was 0.01" we for 1 minute, the flow will be approximately 0.5 cubic feet per minute (cfm) or 0.50 cubic foot of displacement. The actual sewer gas pressure and time interval may be more or less.

Figure 8:
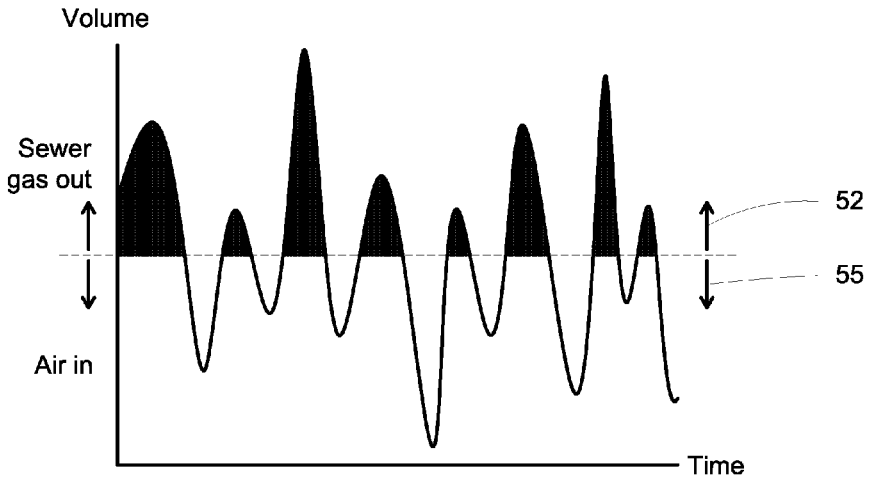
FIG. 8 shows a diagrammatic representation of hypothetical fluctuations of sewer gas and ambient air volume, flow and duration over a period of time. The representation of sewer gas displacement is shown above the base line. The representation of ambient air displacement is shown below the base line.
Figure 9:
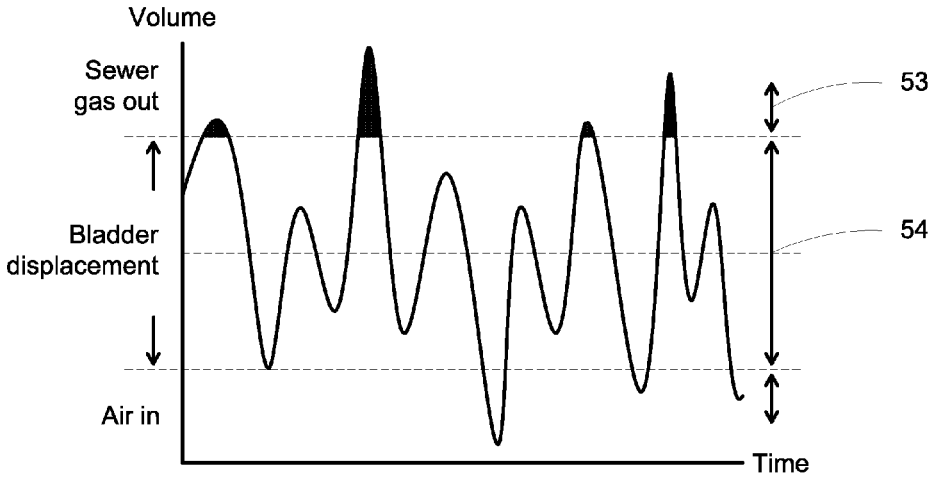
FIG. 9 shows a small portion of the FIG. 8 chart over a brief period of time and fluctuations. The dashed horizontal lines parallel to the baseline and respectively above and below the base line depict the volume retained by the bladder without flow occurring through the cartridge. The dark shading above the dashed line show the sewer gas and ambient treated air flow through the cartridge.

Accurate information is not readily available on the fluctuation frequency, time, volume or flow rate. A schematic copy of sewer gas pressure readings on sewer system is represented in FIGS. 8-9 of the drawings that have been obtained from a specific tested sewer line. On a completely inactive system, a plumbing fixture with 7.5 gallons of water was drained in 1 minute. This caused 1 cubic foot of added volume displacement to the sewer piping system. This displacement caused increased flow in the sewer pipe and affected sewage flow, level and air entrainment along with other conditions including displacement of sewer gas in a manhole. Many homes and businesses are connected to sewer systems and the frequency of plumbing use, flow rates, chemical activity in the sewer system and all the other factors cannot be calculated with any degree of accuracy. Thus, in a typical sewer system it is difficult to predict which manholes within the system will be subject to periodic odor complaints.

The most common odors residential homeowners complain about are the rotten eggs smell of hydrogen sulfide ($H_2S$) and methane ($CH_4$). The odors emanating from wastewater sewer line manholes can be an extreme nuisance to the public and property owners. The persistent nuisance odor complaints translate into costly service and treatment for cities. One interesting result of the implementation of recent codes and regulations to reduce water use by mandating "Low Flow Toilets" and "Low Flow Showers" has been an increase in sewer generated odors. A recent study in San Francisco, Calif. attributed the reduction of water flow into sewer systems to less scrubbing and flushing action along with lower flow level in the sewer pipe and that results in more pipe surface area above the sewage level and that is where more odors are formed. This resulted in a dramatic increase in nuisance odor complaints. San Francisco is spending millions of dollars to add chlorine and chemicals to help reduce the odor complaints.

Figure 10:
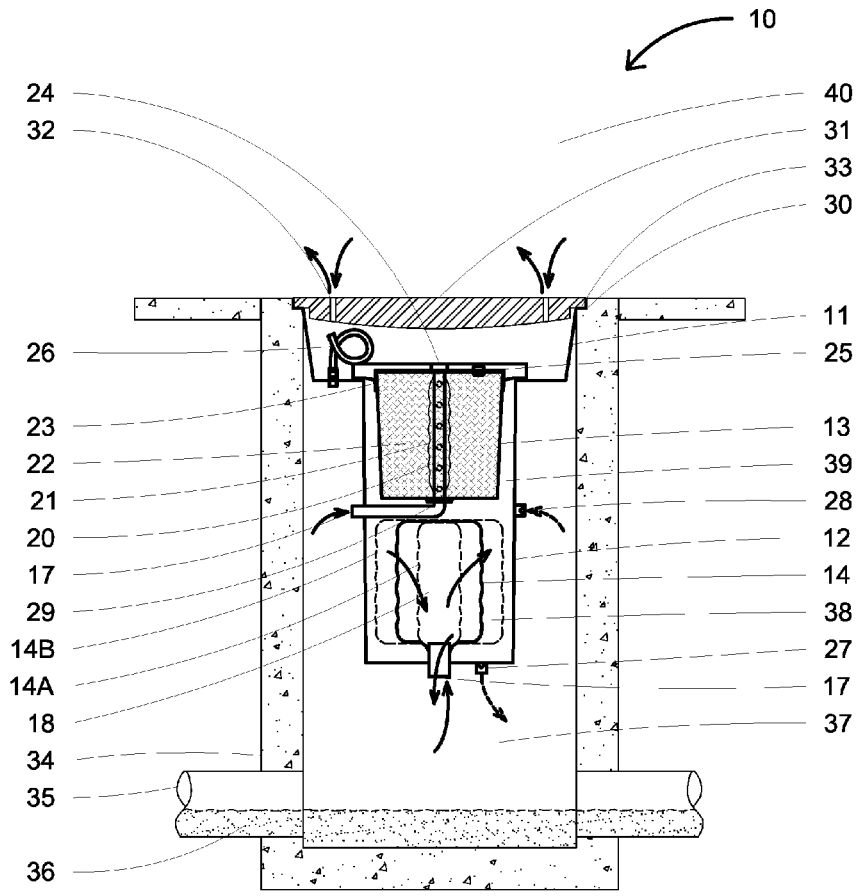
FIG. 10 is a schematic elevation view of a fifth embodiment of a manhole odor eliminator (MOE) in accordance with the present invention that shows the cross-section of a manhole insert, housing, odor absorbing cartridge and bladder. In this variation the bladder has one open connection to the sewer gas and a separate inlet leading to a pressure relief valve at the inlet to the carbon filter.

FIG. 10 is a schematic elevation view of another embodiment of the manhole odor eliminator in accordance with the present invention that shows the cross-section of a manhole insert, housing, odor absorbing cartridge and bladder. In this variation the bladder has one open connection to the sewer gas and a separate inlet leading to a pressure relief valve at the inlet to the carbon filter. This embodiment may be easier to fabricate than the embodiment shown in FIG. 1.

The illustrated embodiments of the present invention position the media in the absorber cartridge 13 above the bladder 14. Other embodiments may reverse this arrangement, however, positioning the media nearer to the manhole cover 31 enables easier access by maintenance personnel who must periodically change the absorption media.

The manhole odor eliminator insert in accordance with the present invention is a substantial improvement over prior art because it includes a variable volume bladder device that accommodates the frequent variations of plus and minus pressure buildup of the gasses above the liquid in the manhole and below the manhole cover. This variable volume device expands and contracts to accommodate the frequent fluctuating small volume changes that will otherwise pass through and deplete the absorber media. This greatly reduces the treated air from entering the sewer gas area and reduces the volume of sewer gas that passes through the cartridge. This greatly reduces all the above service and cartridge related change-out costs. Less absorber medial can be used. Fewer service visits to replace odor absorbing media is required resulting in greater safety for workers and the public along with less cost to the taxpayer. Another advantage of the present apparatus and method is to provide a simple universal housing support band that can easily be adjusted to fit any size manhole and not be dependent on the manhole cover.

ITEM DESCRIPTION

10 Invention. The manhole Odor Eliminator (MOE).

11 Insert. This fits under manhole cover 31 and sets on frame 33 lip. It supports HDPE housing 12 that fits in a hole in the center of the insert 11.

12 Housing. This may be a 15 gallon HDPE open top tank with an extended rim that sets into the insert 11.

13 Odor absorbing cartridge. This cartridge holds 10 to 20 pounds of odor absorbing carbon and other media. The cartridge exterior is perforated or screened 22.

14 Bladder. This bladder accommodated the sewer gas flow from pressure fluctuations. The bladder may be biased in the one half full position.

14A Bladder in the expanded position.

14B Bladder in the deflated position.

15 Water drain trap. This drain trap or P-trap forms a water seal to prevent sewer gas from entering housing 12.

16 Drain tube. This 1" drain tube allows any rainwater that enters manhole cover to drain out of the housing 12 and into the drain trap 15.

17 Riser pipe inlet. This inlet is where sewer gas enters the riser tube and then the bladder.

18 Riser pipe. This riser pipe may be 2" diameter and is perforated and extends from the bottom of the housing and through the center of the cartridge.

19 Orifice. This small orifice may be ½" diameter and is located near the inlet to the cartridge 13 and causes a restriction to flow that result in sewer gasses to first flow into the bladder 14 space.

Perforated riser pipe. This is located above orifice and in center of odor absorbing cartridge 13.

21 Fine mesh screen. This is a screen over the perforated pipe to prevent the odor absorbing media from passing through and entering the perforated riser pipe 20.

22 Screened cartridge housing. This is the outer surface of the cartridge that restrains the carbon media while allowing gas flow to pass through.

23 Cartridge top. This is a removable top to the cartridge to allow access to activated carbon with H2S media for replacement.

24 Secure cap. This is a securing cap that holds the cartridge in place over the perforated riser pipe.

25 Indicator. This is a clear plastic sight glass that shows the color change of indicating media to determine when it is time to replace spent media.

26 Sensing tube. This sensing tube allows test instrument access to the sewer gases to measure H2S concentration without removing the MOE.

27 Low Pressure relief valve. This is located at bottom of housing. This may be flap, ball float or check valve that allows air or water flow at 0.25" water column or other setting.

28 High Pressure relief valve. This is located in housing to allow for high pressure surges of sewer gases that exceed capacity through cartridge to enter the housing. This may be flap, ball float or check valve that allows air or water flow at 3" water column or other setting.

29 Medium Pressure relief valve. This is located in riser pipe between bladder and cartridge. This may be flap, ball float or check valve that allows sewer gas flow at 1" positive water column or other setting.

30 Seal. This is a foam or gasket seal between the insert and the manhole frame lip to form a gas tight seal.

31 Manhole cover. This is the sewer manhole cover.

32 Pick hole. This is the pick hole or vent hole in the manhole. It is used when removing the manhole cover and allows for sewer gas venting and air ingression.

33 Frame. This is the metal frame for the manhole cover.

34 Sewer manhole. This is the basin or manhole where the sewer pipe is located.

35 Sewer pipe. This is the pipe where sewage flows through the base of the manhole.

36 Sewage. This is the liquid sewage that flows through the sewer pipe.

37 Sewer gas. This is a mixture of various sewer gases including hydrogen sulfide H2S, methane gas, CH4 and many other gases.

38 Combination sewer gas and treated air. This mixture occurs within the bladder when sewer gas mixes with treated air due to pressure fluctuations.

39 Treated air. This is the combination air and gas that is located between the manhole cover and the exterior of the bladder within and above the housing and cartridge.

40. Ambient air. This is the ambient air located above the manhole cover.

41. Metal band. This is an expandable ring band that secures to the inside of the manhole below the frame.

42 Ring gasket. This may be used to help seal the metal band to the interior of the manhole.

Note: Items 43-51 apply to the small version of MOE for residential vent systems.

43 Removable service cap.

44 Small carbon cartridge.

45 Small perforated riser pipe.

46 Small bladder.

47 Cartridge housing.

48 Pressure relief valve.

49 Vacuum relief valve.

50 Plumbing vent.

51 Roof surface.

52 Relative volume of sewer gas expelled from manhole with prior art without bladder.

53 Relative volume of sewer gas expelled from manhole with bladder.

54 Restrained fluctuation gases by bladder.

55 Air drawn into manhole with prior art without bladder.

56 Filter. This may contain polypropylene and other filter/absorbent media.

57 P-Trap

112 Flexible housing that also takes the place of a bladder.

112A Flexible housing in the expanded position.

112B Flexible housing in the deflated position.

The terms used in the claims will be better understood by reference to the embodiment of FIG. 1 where the terms "ambient air" refers to air above the manhole cover 31, the term "treated air" refers to air within the housing 12 that is not within the bladder 14 and thus will be treated by the absorber cartridge 13, and "sewer gas" refers to the gas below the cartridge. A goal of the present invention is to have a large volume of treated air ready in the event that a surge of sewer gas exceeds the bladder capacity. "Treated air" is air that is within the housing 12 which at any given time may be a combination of incoming ambient air, air treated by the absorption cartridge 13 and sewer gas that surged through the pressure relief valve 28. All gases within the housing will be exposed to the absorber cartridge 13. Accordingly, any hydrogen sulfide or other sewer gas in the housing 14 will be treated.

The pressure differential between ambient air above the manhole cover and the treated air pressure within the housing 12 is very small. Ambient air above the manhole cover and "treated air" within the housing 12 are in fluid communication with one another because of the pick holes within the manhole cover 24.

The apparatus and method for manhole odor elimination solves all of the above described problems with the prior art apparatus and methods by use of a variable volume device to accommodate the frequent fluctuations of air and gasses passing through the absorber cartridge.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A sewer gas odor absorption apparatus for a manhole having a perforate manhole cover disposed in the manhole which comprises:

an imperforate housing having a seal dimensioned and configured for sealing engagement with the manhole, said housing having a first extremity and a second extremity; said housing having a passageway in fluid communication with ambient air above the manhole cover at said first extremity and in fluid communication with sewer gases at said second extremity thereof;

a sub-assembly comprising a porous absorption media and a variable volume device disposed in mutual fluid communication in a subassembly having first and second axial extremities, said first extremity of said subassembly being disposed in fluid communication with one of said first and second extremities of said imperforate housing and said second extremity of said subassembly being disposed in fluid communication with the other of said first and second extremities of said imperforate housing;

said variable volume device having interior and exterior surfaces and an internal volume that is a function of the internal and external pressures on the respective internal and external surfaces of said variable volume device; and said variable volume device having a first internal volume when the pressure inside of said variable volume device is equal to the pressure on the external surface of said variable volume device.

2. The apparatus as described in claim 1 wherein said first extremity of said sub-assembly is in fluid communication with said first extremity of said housing and said second extremity of said sub-assembly is in fluid communication with said second extremity of said housing.

3. The apparatus as described in claim 1 wherein the internal volume of said variable volume device is exposed to sewer gas and the external surface is exposed to air within said housing that is not within the bladder.

4. The apparatus as described in claim 1 further including a pressure relief valve having an inlet in fluid communication with said housing and an outlet in fluid communication with treated air whereby surges in the sewer gas pressure relieve sewer gas to the interior of the housing and displace an equal volume of treated air that exits the manhole.

5. The apparatus as described in claim 1 wherein said housing is supported by a pan shaped support have a lip engaging the support surface for the manhole cover.

6. The apparatus as described in claim 1 wherein said housing is supported by a band extending around said housing and secured to a side wall of the manhole.

7. The apparatus as described in claim 1 wherein said housing is supported by a band having first and second axial extremities that are respectively fixed to opposed faces of the manhole with the midsection thereof being curvilinear and at a lower elevation than the attachment points for the axial extremities.

8. The apparatus as described in claim 1 wherein said housing includes a perforated riser pipe extending between said first and second extremities of said sub-assembly.

9. The apparatus as described in claim 7 said variable displacement device is concentric with said riser pipe.

10. The apparatus as described in claim 7 wherein said absorbent media is disposed in a cartridge.

11. The apparatus as described in claim 9 wherein said cartridge is substantially concentric with said riser pipe.

12. The apparatus as described in claim 7 wherein said riser pipe is disposed in a substantially vertical orientation in normal operation and the highest extremity is exposed to ambient air and the lowest extremity is exposed to sewer gas.

13. The apparatus as described in claim 1 further including a sensing tube communicating with said housing to allow determination of particular gases that may be present.

14. The apparatus as described in claim 1 further including an indicator that displays the condition of the adsorbent media.

15. The apparatus in claim 1 wherein said variable volume device has volume device has an internal volume without the application of internal or external pressures or other forces that is about half of the maximum internal volume of said variable volume device.

16. A method for removing malodorous and harmful substances from sewer gases passing through and around a perforate manhole cover disposed in a manhole above an existing sewer conduit which comprises:

providing an imperforate housing having an inlet and an outlet, said inlet and said outlet being in fluid communication;

positioning the imperforate housing within the manhole and positioning a seal between the housing and the manhole;

positioning an absorbent media within the housing;

providing fluid communication between the housing and sewer gases in the sewer conduit;

providing fluid communication between the outlet of the housing and ambient air above the perforate manhole cover;

positioning within the housing a variable volume device having a first internal volume when the pressure inside of said variable volume device is equal to the pressure on the external surface of said variable volume device;

providing fluid communication between sewer gases below said housing and the internal volume within the variable volume device;

providing fluid communication between ambient air above the manhole cover and the outer surface of the variable volume device;

providing fluid communication between the internal volume of the variable volume device and the absorber media within the housing whereby the flow through the media is minimized by utilizing the variable volume device as a cache that reduces the impact of oscillations in sewer gas pressure and ambient air pressure.

17. Apparatus for removing odors from an associated building vent such as the vent used for bathroom plumbing which comprises:

a perforated riser pipe dimensioned and configured to engage and axially extend from the associated building vent that substantially seals with respect to the associated building vent to force all gases flowing through the vent to pass through the perforated riser pipe;

a housing engaging the top of the vent and surrounding said riser pipe;

a variable volume device surrounding said riser pipe within said housing; and an absorbent media disposed within said housing that is in fluid communication with said riser pipe whereby fluctuations in the pressure of gases rising through the vent and riser pipe and the pressure of the ambient air have a reduced impact on the total flow through the absorbent media because the variable volume device acts as a cache.

18. A sewer gas odor absorption apparatus for a manhole having a perforate manhole cover disposed in the manhole which comprises:

an imperforate flexible housing having a seal dimensioned and configured for sealing engagement with the manhole, said housing having a first extremity and a second extremity; said housing having a passageway in fluid communication with ambient air above the manhole cover at said first extremity and in fluid communication with sewer gases at said second extremity thereof; and a porous absorption media, said imperforate flexible housing having internal and external surfaces and an internal volume that is a function of the internal and external pressures on the respective internal and external surfaces of said imperforate flexible housing.

* * * * *